US010308387B2

(12) United States Patent
Bacallao

(10) Patent No.: US 10,308,387 B2
(45) Date of Patent: Jun. 4, 2019

(54) BAGGING CLIP TOOL FOR A BAGGING STATION

(71) Applicant: Walmart Apollo, LLC, Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/831,561

(22) Filed: Dec. 5, 2017

(65) Prior Publication Data

US 2018/0170597 A1 Jun. 21, 2018

Related U.S. Application Data

(60) Provisional application No. 62/435,229, filed on Dec. 16, 2016.

(51) Int. Cl.
*A47F 9/04* (2006.01)
*B65B 67/00* (2006.01)
(Continued)

(52) U.S. Cl.
CPC ..... *B65B 51/043* (2013.01); *A45F 5/1046* (2013.01); *B65B 67/1266* (2013.01); *A47F 9/042* (2013.01)

(58) Field of Classification Search
CPC ..... B65B 67/1266; B65B 67/1222; B65B 67/1227; B65B 67/1233; B65B 51/043;
(Continued)

(56) References Cited

U.S. PATENT DOCUMENTS 361,852 A * 4/1887 Alderman ..... A47F 1/128 211/54.1
842,959 A * 2/1907 Kaufman ..... B65H 35/0006 225/67
(Continued)

FOREIGN PATENT DOCUMENTS

EP 1138601 A1 10/2001
GB 2361740 A 10/2001

OTHER PUBLICATIONS

International Search Report and Written Opinion for PCT Application No. PCT/US2017/064593, dated Feb. 16, 2018.
(Continued)

*Primary Examiner* — Ingrid M Weinhold
(74) *Attorney, Agent, or Firm* — Schmeiser, Olsen & Watts LLP

(57) ABSTRACT

Disclosed is a bagging clip tool that couples to a shopping bag bagging station. The bagging clip tool helps to keep shopping bags hung from a bag holder hook in place as one of the shopping bags is opened, filled and removed. The bagging clip tool includes a handle, a clip coupled to a first end of the handle, and a T bar with a pair of wheels coupled to a second end of the handle. The clip keeps shopping bags hung from the bag holder hook in place as individual shopping bags are filled and removed from the bag holder hook. The pair of wheels easily grab and separate the two sides of the shopping bag so a user can open the shopping bag without fumbling.

14 Claims, 8 Drawing Sheets

(51) Int. Cl.
*B65B 51/04* (2006.01)
*A45F 5/10* (2006.01)
*B65B 67/12* (2006.01)

(58) Field of Classification Search
CPC ..... A45F 5/1046; A47F 9/042; Y10T 24/20; Y10T 24/204
USPC ..... 248/97, 99–101, 504; 206/554; 211/51, 211/53, 50, 12; 221/43; 281/45; 242/422.5; 225/106
See application file for complete search history.

(56) References Cited

U.S. PATENT DOCUMENTS 933,663 A * 9/1909 Pollock ..... G07F 11/045 221/41
1,245,494 A * 11/1917 Morris ..... B42F 17/02 211/51
1,390,175 A * 9/1921 Stone ..... B65H 3/22 221/213
1,391,326 A * 9/1921 Killian ..... A47K 10/38 242/422.5
1,452,492 A 4/1923 Carpenter
1,579,135 A * 3/1926 Olson ..... B42D 17/005 232/4 R
1,840,485 A * 1/1932 Butler ..... B21D 51/00 206/0.81
1,843,692 A * 2/1932 McDonald ..... B43M 9/00 16/403
1,972,214 A * 9/1934 Bergman ..... G07D 11/0006 211/51
2,026,454 A 12/1935 Hugo
2,084,409 A * 6/1937 Peterson ..... B42F 7/10 16/403
2,204,117 A 6/1940 Harry
2,633,615 A * 4/1953 Donovan ..... B42F 17/02 206/449
3,117,694 A * 1/1964 Gothreau ..... B43M 13/00 221/23
3,262,579 A * 7/1966 Reich ..... A47G 25/0657 211/45
3,361,294 A 1/1968 Bjerum
3,434,686 A * 3/1969 Yoshizaburo ..... A47L 13/512 211/45
3,503,481 A * 3/1970 Brenner ..... G07F 11/045 194/240
D217,903 S 6/1970 Derenski
3,860,192 A * 1/1975 Morris ..... B65H 23/08 242/421.5
3,918,661 A * 11/1975 Kishi ..... A47K 10/38 242/422.5
4,024,606 A * 5/1977 Tripp ..... B42F 9/001 24/510
4,516,384 A 5/1985 Imperiale
4,771,966 A * 9/1988 Anderson ..... A47K 10/40 225/51
4,819,898 A 4/1989 Benoit et al.
4,830,317 A * 5/1989 Kober ..... B65B 43/26 221/36
4,952,093 A 8/1990 Murakami
4,955,506 A * 9/1990 Schweiberer ..... B65H 3/22 221/213
4,974,764 A 12/1990 Cantwell
5,054,675 A * 10/1991 Taves ..... A47K 10/38 225/19
5,118,022 A 6/1992 Farahnik
5,137,134 A * 8/1992 La Spina ..... G07F 11/045 194/248
5,213,145 A 5/1993 Huang et al.
5,221,011 A * 6/1993 Coto ..... A47F 7/14 211/43
D347,171 S 5/1994 Specht et al.
5,323,909 A 6/1994 Piraneo et al.
5,340,634 A 8/1994 Adams
D356,261 S 3/1995 Miceli, Jr.
5,465,845 A 11/1995 Norby et al.
D373,070 S 8/1996 Kriegstein
5,797,166 A 8/1998 Wagenheim
D414,537 S 9/1999 Crate
6,152,366 A * 11/2000 Maddox ..... G07D 11/0024 206/565
6,179,126 B1 1/2001 Smithson et al.
6,325,214 B1 * 12/2001 Smithson ..... A47F 9/042 206/554
6,382,429 B1 5/2002 Yeh et al.
6,389,652 B1 5/2002 Williams
6,508,381 B1 1/2003 Sadi
6,729,483 B1 * 5/2004 Nguyen ..... A47F 9/042 206/554
D503,095 S 3/2005 Burr et al.
D514,431 S 2/2006 Tanaka et al.
7,090,106 B2 * 8/2006 Holden ..... A47K 10/3836 225/106
D540,153 S 4/2007 Tanaka et al.
D544,792 S 6/2007 Camarella
D549,073 S 8/2007 Gilbert et al.
7,275,657 B2 10/2007 Geyer
7,387,324 B1 6/2008 Sharpe
D592,508 S 5/2009 Perignon
D593,411 S 6/2009 Bizzell
D595,130 S 6/2009 Bizzell
D597,828 S 8/2009 Tanaka
D601,420 S 10/2009 Miceli, Jr.
D623,500 S 9/2010 Langner et al.
7,926,149 B2 4/2011 Weston
7,980,411 B2 7/2011 Kasbohm
8,028,873 B2 10/2011 Hawk et al.
8,196,873 B2 6/2012 Kohn et al.
8,261,460 B2 9/2012 Essel
8,568,190 B2 10/2013 Nelson et al.
8,584,982 B2 * 11/2013 Eakin ..... A47K 10/38 242/422.5
9,078,534 B2 7/2015 Manasharov et al.
D752,867 S 4/2016 Morszeck
D795,061 S 8/2017 Bacallao
9,770,123 B2 * 9/2017 Tan ..... A47F 13/085
2002/0033406 A1 * 3/2002 Holden ..... A47K 10/38 225/96.5
2002/0078534 A1 6/2002 Williams
2004/0051331 A1 3/2004 Freedlund
2004/0159756 A1 8/2004 Albertson
2005/0045685 A1 3/2005 Sesto
2007/0113453 A1 5/2007 Dickinson
2008/0197245 A1 8/2008 Weldon et al.
2009/0289019 A1 * 11/2009 Alvarado ..... A47F 13/085 211/85.15
2010/0067831 A1 3/2010 Alvarado et al.
2010/0314507 A1 * 12/2010 Laitila ..... B65B 67/1227 248/97
2011/0108598 A1 * 5/2011 Bruner ..... A47K 10/38 225/10
2013/0092804 A1 * 4/2013 Laitila ..... B65B 67/1227 248/97
2013/0223766 A1 8/2013 Gebhardt
2014/0216962 A1 8/2014 Higdon et al.
2017/0055727 A1 * 3/2017 Tan ..... A47F 13/085

OTHER PUBLICATIONS

Non-Final Office Action in U.S. Appl. No. 15/472,658 dated Jun. 13, 2018; 8 pages.
Notice of Allowance in U.S. Appl. No. 15/472,658 dated Oct. 17, 2018; 7 pages.
Notice of Allowance in Design U.S. Appl. No. 26/560,807, dated May 9, 2017; 10 pages.
"Single Pronged Display Hook Security," Stacey-Europe.com, accessed Oct. 27, 2016.
Search Report in UK Patent Application No. GB1704784.6, dated Sep. 29, 2017; 3 pages.

(56) References Cited

OTHER PUBLICATIONS

"2X Power Plug Socket Jack Hook Rack Holder Hanger Home Wall Decor Organizer", Aliexpress.com, accessed on Apr. 14, 2016; 13 pages.
"Closetmaid Superslide J Bracket Support WHI", Masters Home Improvement, accessed on Apr. 14, 2016; 4 pages.
"1pc New Design Cartoon Animal Bear/Cat/Frog Kitchen Suction Racks Home Supplies", Aliexpress.com, accessed on Apr. 14, 2016; 8 pages.
"1 X Cargo Trunk Bag Hook Kit for VW Passat CC B6 Jetta Audi A4 S4", Amazon.com, accessed on Apr. 14, 2016; 6 pages.
Internet Image, https://s-media-cache-ak0.pinimg.com/236x/d4/85/9c/d4859cecfa5b23d54739860212d9b1eb.jpg, accessed on Apr. 14, 2016; 1 page.

* cited by examiner

BAGGING CLIP TOOL FOR A BAGGING STATION

CROSS REFERENCE TO RELATED APPLICATION

This invention claims priority to U.S. provisional patent application Ser. No. 62/435,229, filed Dec. 16, 2016 to Applicant Wal-Mart Stores Inc., and entitled "Bagging Clip Tool and Method of Forming the Same", which is incorporated entirely herein by reference.

BACKGROUND OF THE INVENTION

Technical Field

This invention relates to bagging stations used in retail stores, and, more specifically, to a bagging clip tool used to hold shopping bags on a bag holder hook of a bagging station.

State of the Art

A bagging station is a fixture for dispensing shopping bags in a retail store. Each bagging station includes a bag holder. A bag holder holds a stack of shopping bags, and dispenses these bags as they are filled with products a customer has purchased. The shopping bags are held by the bag holder at the bagging station in a manner and position such that it is easy and convenient for a person to open one bag at a time, place purchased items in the bag, and then remove the bag with the enclosed products from the bagging station. Shopping bags are slid onto a bag holder hook of the bag holder in a stack, and are pulled open one at a time from the bag holder hook. The problem is, when one bag is pulled open or off of the bag holder hook, one or more additional bags often fall off the bag holder hook and need to be replaced. It takes time and effort for employees and customers to repeatedly replace the stack of shopping bags on the bag holder hook after the bags have inadvertently fallen off or slid off. Rubber bands or tape are often used on the bag holder hook to try to hold the stack of shopping bags on the bag holder hook, but these fixes are temporary and ineffective. In addition, it can be hard to open the next bag in the stack once one bag is removed. The two sides of the shopping bag tend to stick together, and a user often has to fumble with the bag to open it.

Accordingly, what is needed is a device that holds the stack of shopping bags on the bag holder hook, and helps the user to open the next bag in the stack once a shopping bag has been removed.

DETAILED DESCRIPTION OF EMBODIMENTS OF THE INVENTION

Figure 1:
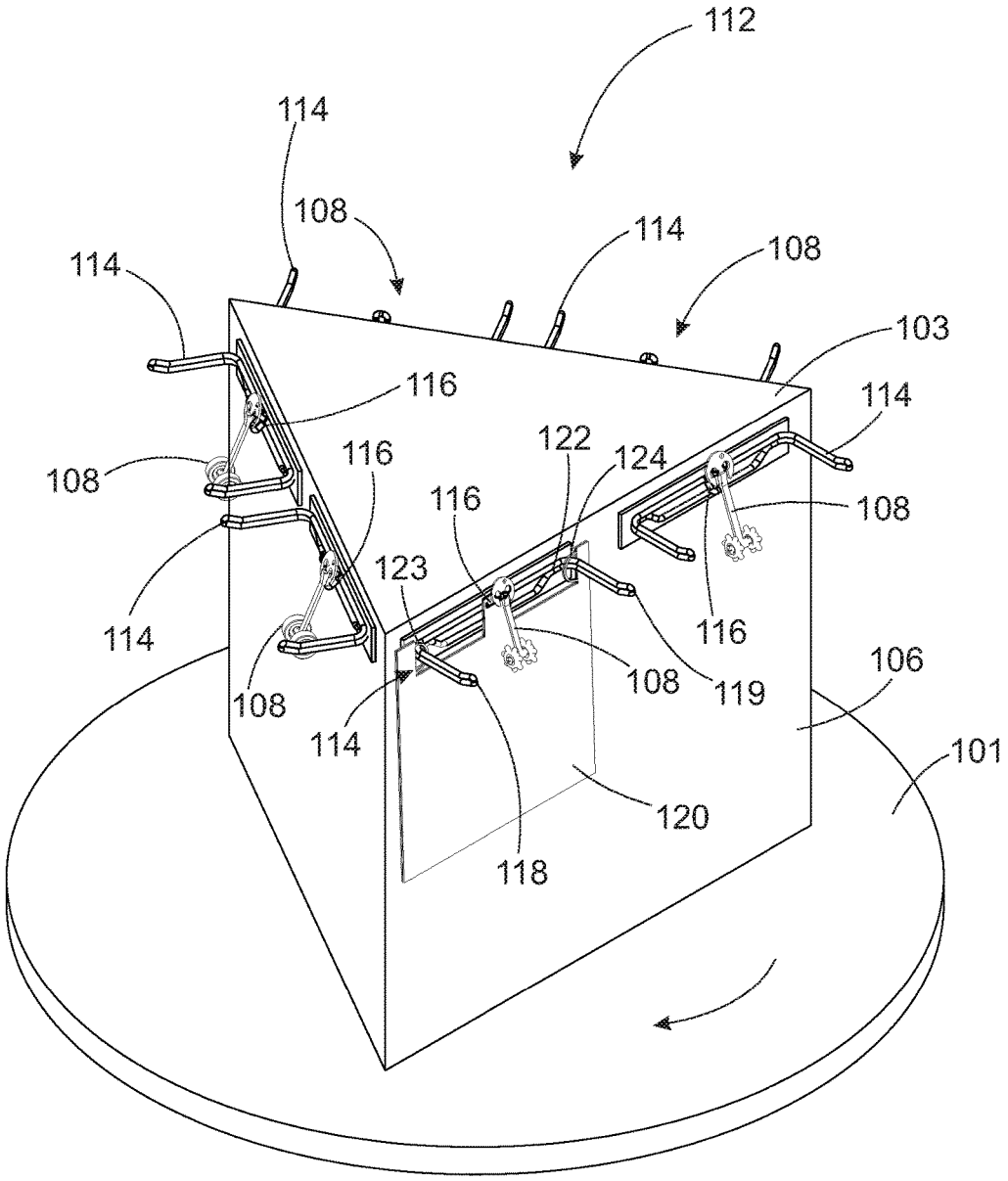
FIG. 1 show a perspective view of a bagging station with a number of bag holders, where each bag holder has a bagging clip tool coupled to a bag holder hook of the bag holder.

As discussed above, embodiments of the present invention relate to bagging stations used in retail stores, and, more specifically, to a bagging clip tool used at a bagging station. The bagging clip tool is used to hold shopping bags on a bag holder hook of a shopping bag holder, and to help open one bag at a time of the shopping bags.

Disclosed is a shopping bag bagging station that includes a bag holder and a bagging clip tool. The bag holder includes a bag holder hook. The bag holder hook holds at least one shopping bag. The bagging clip tool couples to the bag holder hook. The bagging clip tool helps to keep shopping bags hung from the bag holder hook in place as one of the shopping bags is opened, filled, and then removed from the bag holder. The bagging clip tool also helps to open each shopping bag to be filled. The bagging clip tool includes an elongate handle, a clip coupled to a first end of the handle, and a pair of wheels coupled to a second end of the handle. The clip holds the stack of shopping bags on the bag holder hook. The pair of wheels help open each bag to be filled. The clip includes a flat plate, such as a round disk, with at least one slot in the flat plate. The slot is configured to couple to a rail of the bag holder hook of the bag holder. Once the bagging clip tool is coupled to the bag holder hook, shopping bags hung from the bag holder hook will stay in place as individual shopping bags are filled and removed from the bag holder hook. The pair of wheels are rubber and rotate freely. The pair of wheels are positioned to hang from the handle along the front side of the stack of shopping bags. Rotating one or both of the rubber wheels tends to pull the front side away from the back side of a shopping bag that is next to be opened and filled. This pulling of the front side separates the front side of the shopping bag from the rear side, helping to open the shopping bag and allowing the user a way to grab the front side to pull the shopping bag open.

The bagging clip tool saves employees and customers time because they no longer have to replace shopping bags that have inadvertently fallen off the bag holder hook when one shopping bag is removed. The bagging clip tool also makes it easier to open each bag in succession, saving time that is often spent fumbling with the shopping bag trying to open it. The bagging clip tool has a strap hole for coupling a strap, cord, or wire to the bagging clip. The strap, cord, or wire is used to couple the bagging clip tool to the bag holder or the bagging station, so the bagging clip tool does not get lost or separated from the bagging station.

Disclosed is a bagging clip tool for a shopping bag bagging station that includes a means to prevent a shopping bag from falling off a bag holder hook, and a means to open the shopping bag. Once the bagging clip tool is coupled to the bag holder hook, the bagging clip tool holds a plurality of shopping bags on the bag holder hook, keeping the plurality of shopping bags from sliding off or falling off of the bag holder hook as individual shopping bags are filled or removed from the bag holder hook. And the bagging clip tool provides a means to easily and quickly open a shopping bag for filling.

Figure 2:
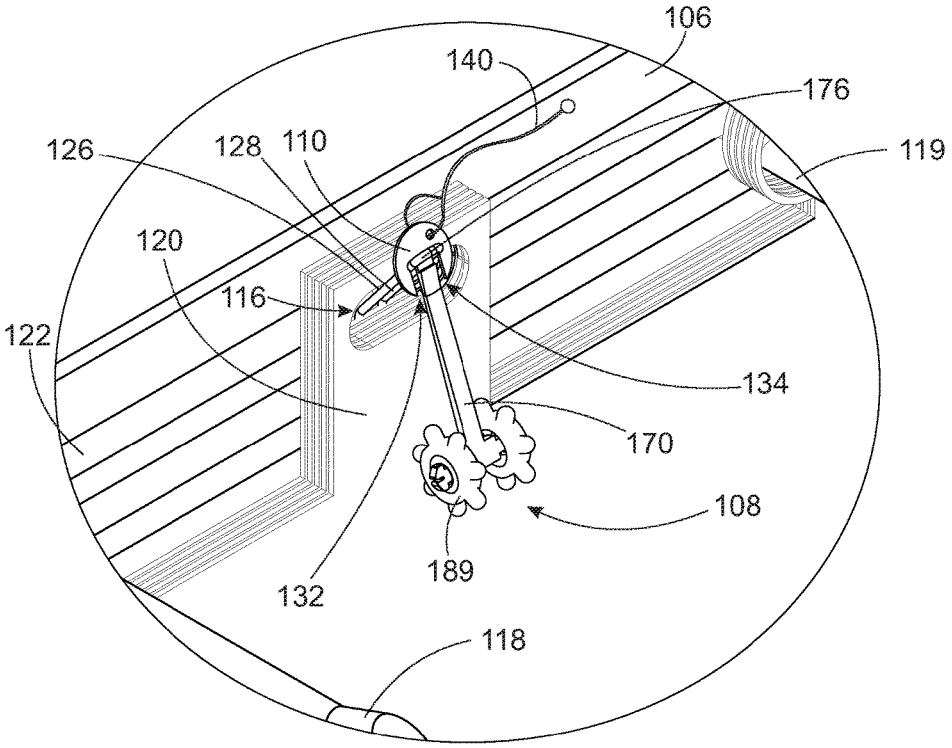
FIG. 2 shows a close-up view of a bag holder hook of a bag holder of the bagging station of FIG. 1, with a plurality of shopping bags and a bagging clip tool coupled to the bag holder hook.

FIG. 1 and FIG. 2 show a bagging station 112 that includes a bag holder 114 having a bag holder hook 116, and a bagging clip tool 108. FIG. 1 shows a perspective view of bagging station 112. FIG. 2 shows a close up view of a bag holder hook 116 of bag holder 114, where bag holder hook 116 has at least one shopping bag 120 hung from bag holder hook 116, and bag holder hook 116 also has bagging clip tool 108 hung from bag holder hook 116.

FIG. 1 shows a front perspective view of a shopping bag bagging station 112 that includes a plurality of shopping bag holders 114 and bagging clip tools 108. Bagging station 112 is a carousel-type bagging station, in this embodiment, that is often used at a checkout register of a retail store for bagging items that have been purchased in the retail store. Bagging station 112 includes a rotating platform 101 and a center section 103. Center section 103 has a number of bag holders 114, including two bag holders 114 on a side 106 as shown in FIG. 1. Each bag holder 114 has a bag holder hook 116 that holds one or more shopping bags 120. Each bagging clip tool 108 is coupled to one of the multiple shopping bag holders 114 of bagging station 112. Specifically, each bagging clip tool 108 is coupled to bag holder hook 116 of one of the bag holders 114, as shown in FIG. 1. Bagging clip tool 108 is used to keep shopping bag 120 hanging from bag holder hook 116 of shopping bag holder 114, and to help a user of bagging station 112 open shopping bag 120. Each bag holder 114 holds and dispenses one or more shopping bag 120. When a shopping bag 120 is opened, filled, and/or removed from bag holder hook 116, bagging clip tool 108 keeps the remainder of the shopping bags hanging from bag holder hook 116 from falling off of bag holder hook 116.

It is to be understood that bagging station 112 can have fewer or more bag holders 114 than is shown in FIG. 1. It is to be understood that bagging station 112 can take many different forms.

Bag holder 114 is used to hold at least one shopping bag 120 at bagging station 112. Bag holder 114 can take many different forms. Bag holder 114, in this embodiment, includes a support bar 122, a first handle holder arm 118 and a second handle holder arm 119 coupled to and extending from support bar 122, and a bag holder hook 116 coupled to and extending from support bar 122, as shown in FIG. 1 and FIG. 2. Support bar 122 has a support bar first end 123 and a support bar second end 124, as shown in FIG. 1. First handle holder arm 118 is coupled to, and extends from, support bar first end 123. Second handle holder arm 119 is coupled to, and extends from, support bar second end 124. Bag holder hook 116 is coupled to, and extends from, support bar 122 between first handle holder arm 118 and second handle holder arm 119.

Shopping bag 120 is hung on bag holder hook 116, with the arms of shopping bag 120 hung on each of handle holder arms 118 and 119, as shown in FIG. 1. Bag holder 114 is a part of bagging station 112 in the embodiment shown in FIG. 1. Bag holder 114 is the part of bagging station 112 that dispenses one or more shopping bag 120. Bag holder 114 can take many different forms, but each bag holder 114 has a bag holder hook 116 that holds at least one shopping bag 120.

FIG. 2 shows a close-up front perspective view of bag holder hook 116 holding a plurality of shopping bags 120, with bagging clip tool 108 coupled to bag holder hook 116. Bag holder hook 116 in this embodiment includes a first rail 126 and a second rail 128. Bagging clip tool 108 couples to first rail 126 and second rail 128 in this embodiment.

Bagging clip tool 108 includes a clip 110, a handle 170, and a pair of wheels 189. Clip 110 keeps plurality of shopping bags 120 from sliding off or falling off of bag holder hook 116 as one shopping bag 120 is opened, filled, or removed from bag holder hook 116. Clip 110 allows one at a time of shopping bags 120 to be opened and removed, while keeping the remaining shopping bags 120 hanging from bag holder hook 116. Rotating one or both wheels of pair of wheels 189 helps to open shopping bag 120 so that shopping bag 120 hung from bag holder hook 116 can be opened and filled. The rotation of pair of wheels 189 pulls a front side of a shopping bag 120 away from the rear side and makes it easier to grab the front side to open shopping bag 120.

Clip 110 of bagging clip tool 108 is a means to prevent shopping bag 120 from falling off of bag holder hook 116. Pair of wheels 189 of bagging clip tool 108 is a means to open shopping bag 120 so that shopping bag 120 is ready to be filled.

Figure 3:
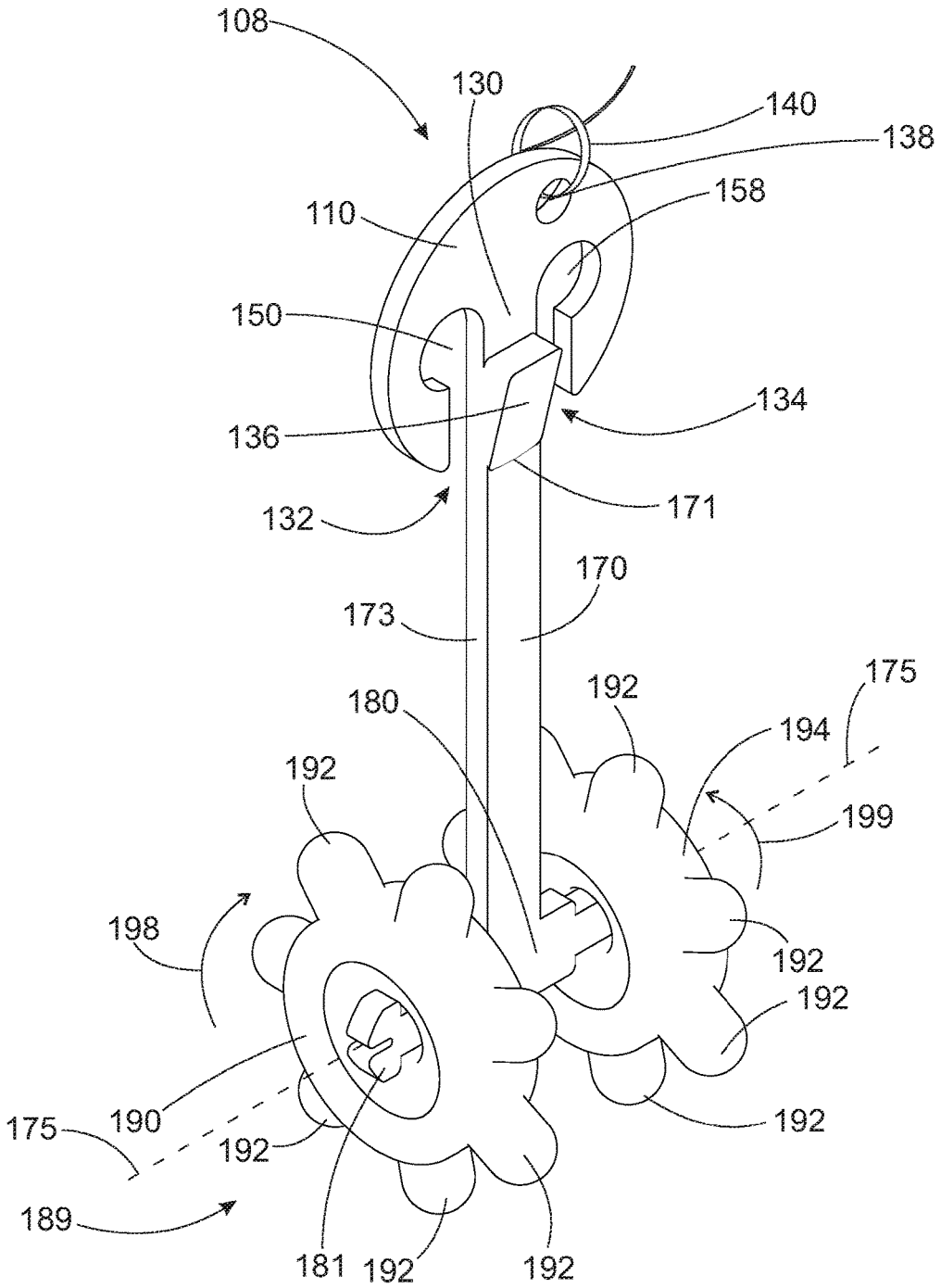
FIG. 3 shows a front perspective view of a bagging clip tool.
Figure 4:
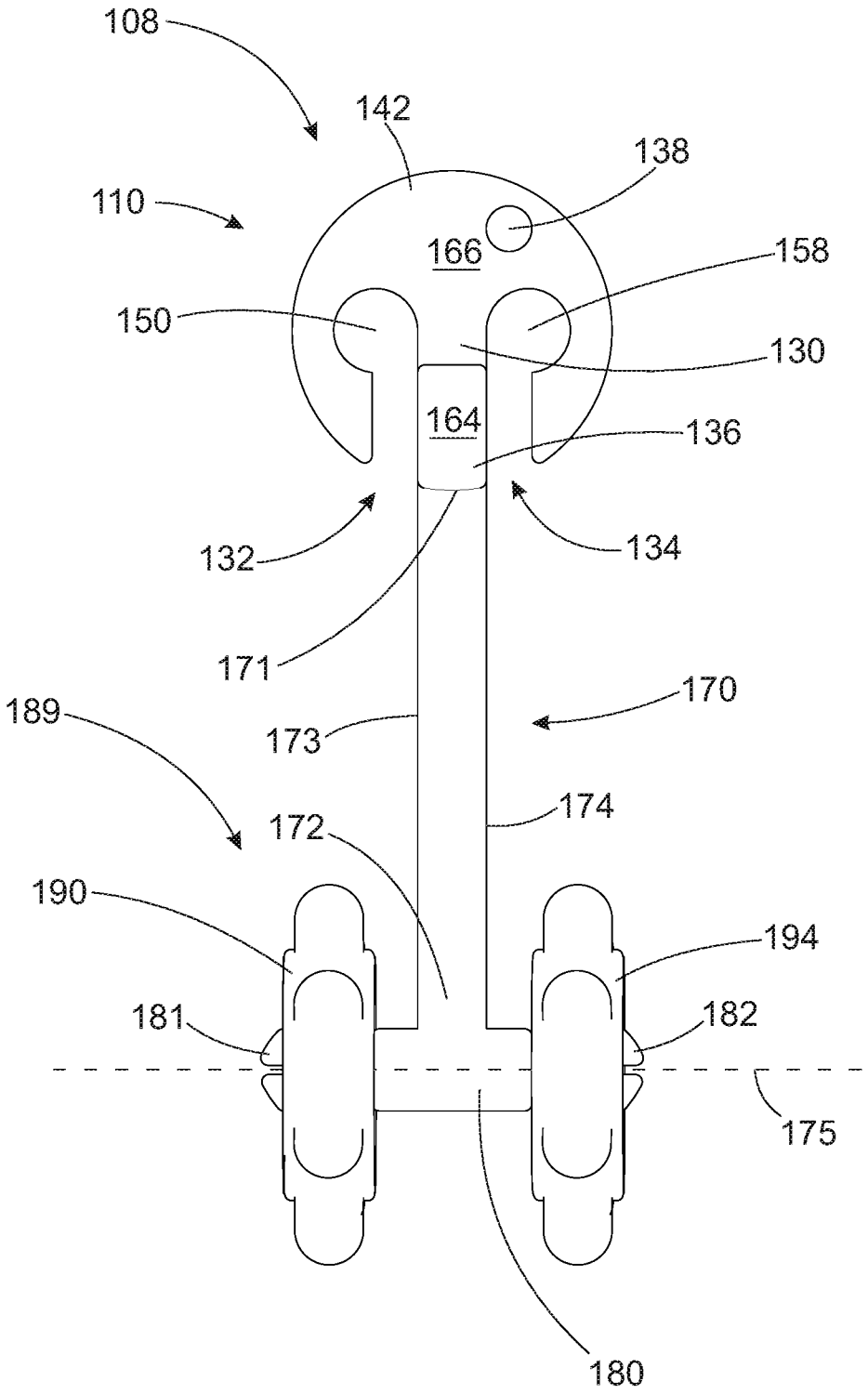
FIG. 4 shows a front view of the bagging clip tool of FIG. 3.
Figure 5:
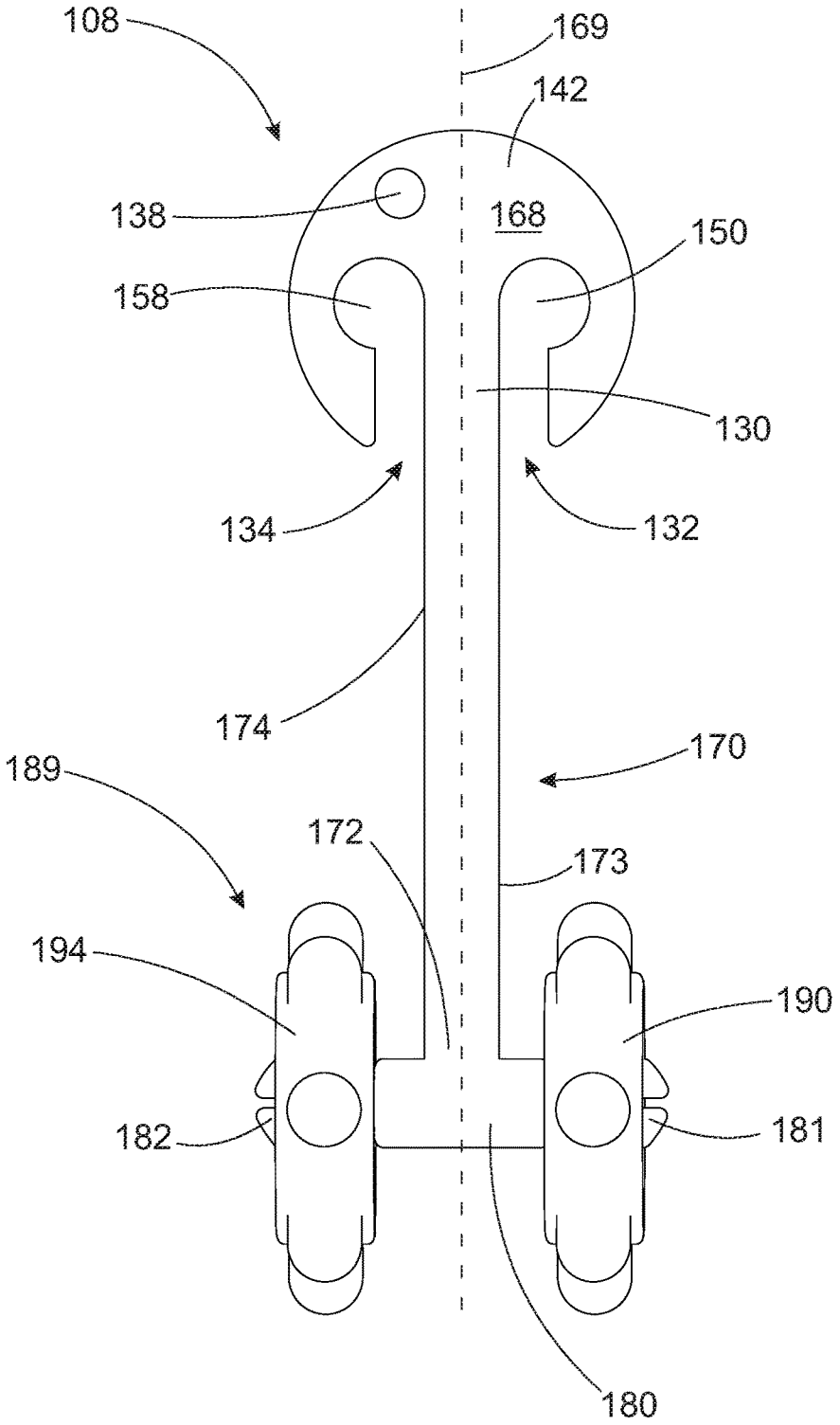
FIG. 5 shows a rear view of the bagging clip tool of FIG. 3.
Figure 6:
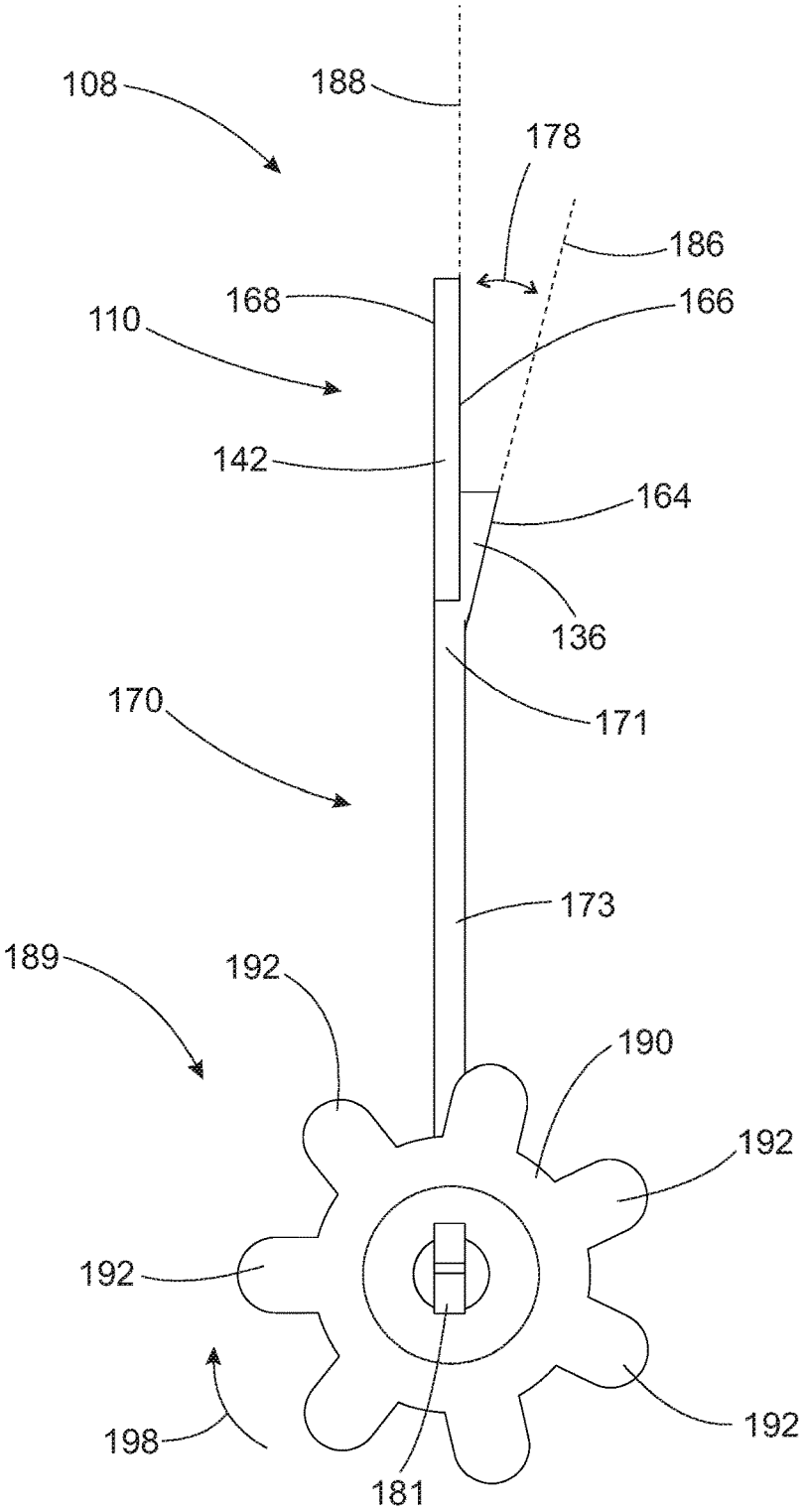
FIG. 6 shows a side view of the bagging clip tool of FIG. 3.
Figure 7:
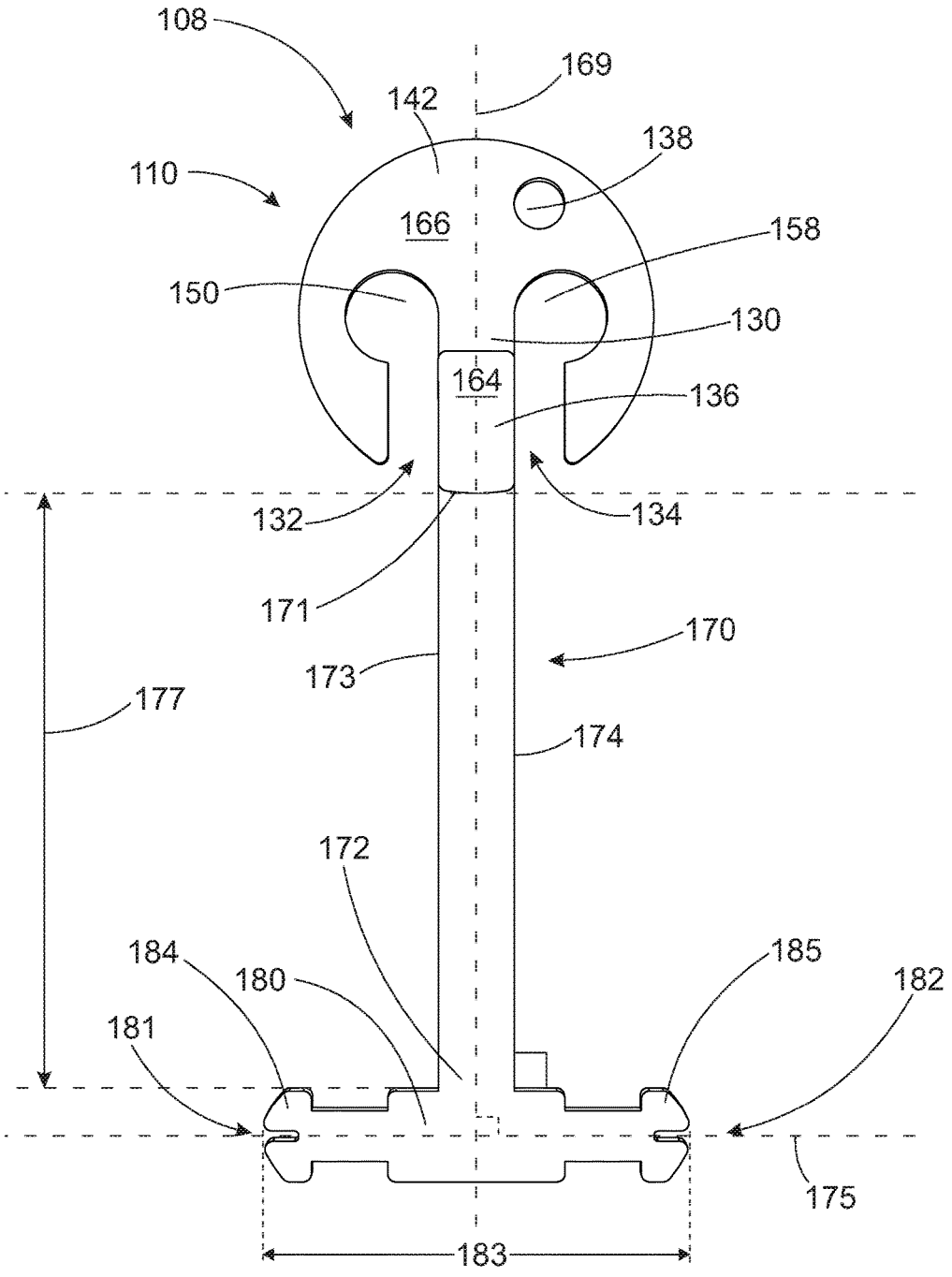
FIG. 7 shows a front view of a handle of the bagging clip tool of FIG. 3, with the pair of wheels removed.

FIG. 3 through FIG. 7 show additional details of bagging clip tool 108. FIG. 3 shows a front perspective view of bagging clip tool 108. FIG. 4 shows a front view of bagging clip tool 108. FIG. 5 shows a rear view of bagging clip tool 108. FIG. 6 shows a side view of bagging clip tool 108. FIG. 7 shows a front view of bagging clip tool 108 with pair of wheels 189 removed to show T bar 180.

Bagging clip tool 108 includes elongate handle 170, clip 110 coupled to a handle first end 171 of handle 170, and pair of wheels 189 coupled to a handle second end 172 of handle 170. Pair of wheels 189 in this embodiment is coupled to a bar 180, which is coupled to handle second end 172.

Handle 170 is an elongate bar or rod formed of rigid material such as, but not limited to, metal, plastic, or wood. Handle 170 has handle first end 171, handle second end 172 opposing handle first end 171, a first side 173 and a second side 174, and a handle longitudinal axis 169 (see FIG. 5 and FIG. 7) extending longitudinally from handle first end 171 to handle second end 172, as can be seen in the figures. Handle 170 has a handle length 177 (FIG. 7) that extends from clip 110 to bar 180. Handle 170 couples clip 110 to bar 180 and pair of wheels 189. Handle 170 extends from clip 110 between a first slot 132 and a second slot 134 in clip 110, as seen in FIG. 3 through FIG. 5.

Clip 110 is coupled to handle first end 171. Clip 110 couples bagging clip tool 108 to bag holder 114 (FIG. 1) by coupling to a first rail 126 and a second rail 128 of bag holder hook 116, as shown in FIG. 2. Bag holder hook 116, in the embodiment shown in FIG. 1 and FIG. 2, is formed in part of a number of metal rails, which includes first rail 126 and second rail 128 in this embodiment (see FIG. 2). Bagging clip tool 108, in this embodiment, is designed for use with a bag holder hook 116 that has two parallel rails (or rods or bars) 126 and 128 that are fairly close together (about $1/16^{th}$ inch to ½ inch apart in the embodiment shown). First rail 126 and second rail 128 are parallel to each other in this embodiment, and are coupled together at an end 176 of bag holder hook 116.

Referring back to FIG. 3 through FIG. 7, clip 110 includes a flat circular disk 142, first and second slots 132 and 134, a center support 130, and a locking protrusion 136. Clip 110 is formed of disk 142, which in this embodiment is a flat circular disk 142. It is to be understood that disk 142 and clip 110 can be many other shapes and configurations other than a flat disk. In some embodiments, clip 110 is formed of a plate with a shape different from a disk.

Disk 142 includes at least one slot, which in this embodiment includes first slot 132 and second slot 134 in disk 142. Slots 132 and 134 couple disk 142 to rails 126 and 128 of bag holder hook 116 (FIG. 2). First slot 132 and second slot 134 are about $1/16^{th}$ to ½ inch apart, in this embodiment, because rails 126 and 128 are about $1/16^{th}$ inch to ½ inch apart. It is to be understood that other dimensions of rail holder hook 116 and slots 132 and 134 are possible. First slot 132 and second slot 134, in this embodiment, are the means to couple disk 142 to bag holder hook 116 of shopping bag holder 114. In this embodiment, first slot 132 is a means to couple disk 142 of clip 110 to first rail 126 of bag holder hook 116, and second slot 134 is a means to couple disk 142 of clip 110 to second rail 128 of bag holder hook 116. The use of two slots, first slot 132 and second slot 134, ensures that bagging clip tool 108 couples securely to bag holder hook 116 and does not fall off of bag holder hook 116. It is to be understood that bag holder hook 116 can take many other forms, and the means to couple clip 110 of bagging clip tool 108 to bag holder hook 116 can take many different forms other than first and second slots 132 and 134. In some embodiments, clip 110 includes only one slot that couples clip 110 to bag holder hook 116.

First and second slot 132 and 134 are each elongate slot cutouts in disk 142 (see FIG. 3 through FIG. 7). The cutouts extend all the way through disk 142, from a disk front surface 166 (FIG. 4 and FIG. 6) to a disk back surface 168 of disk 142. First slot 132 and second slot 134 are approximately parallel to each other in the embodiment of clip 110 shown in the figures, but this is not meant to be limiting. In some embodiments, first slot 132 and second slot 134 are not parallel to each other.

Center support 130 is between first slot 132 and second slot 134. Handle 170 extends from disk 142 by extending from center support 130. First slot 132 and second slot 134 are on either side of handle 170 and center support 130. First slot 132 is adjacent first side 173 of handle 170. Second slot 134 is adjacent second side 174 of handle 170.

First slot 132 includes a first rail hole 150 that captures first rail 126 when clip 110 is coupled to first rail 126. First rail hole 150 has a diameter that is slightly larger than first rail 126, and is also larger than a width of the remainder of the length of first slot 132. Second slot 134 includes a second rail hole 158 that captures second rail 128 when clip 110 is coupled to second rail 128. Second rail hole 158 has a diameter that is slightly larger than second rail 128, and is also larger than a width of the remainder of the length of second slot 134. Clip 110 is coupled to bag holder hook 116 in this embodiment by sliding first rail 126 into first slot 132 until first rail 126 is captured in rail hole 150, and sliding second rail 128 into second slot 134 until second rail 128 is captured in rail hole 158, as shown in FIG. 2.

Center support 130 is between first and second slots 132 and 134. Center support 130 keeps bagging clip tool 108 from sliding off end 176 of bag holder hook 116. As clip 110 slides to end 176 of bag holder hook 116, center support 130 hits end 176 of bag holder hook 116, keeping clip 110 from falling off of bag holder hook 116. Center support 130 in this embodiment includes a locking protrusion 136 that extends from disk front surface 166 of disk 142. Locking protrusion 136 is a sloped protrusion in this embodiment, see FIG. 3 and FIG. 6. Locking protrusion 136 is a triangle-shaped protrusion that protrudes from disk front surface 166. Locking protrusion 136 has a protrusion front surface 164 (see FIG. 4 and FIG. 6). Protrusion front surface 164 of locking protrusion 136 is sloped such that protrusion front surface 164 lies in a protrusion plane 186 that is not parallel to a disk plane 188 of disk front surface 166, as shown in FIG. 6. An angle 178 is between protrusion plane 186 and disk plane 188. In this embodiment, angle 178 is about 15 degrees. In some embodiments, angle 178 is between 10 degrees and 20 degrees. An angle 178 of between 10 and 20 degrees provides the optimum shape of locking protrusion 136 so that locking protrusion 136 catches end 176 of bag holder hook 116 (FIG. 2). The sloped shape of locking protrusion 136 helps center support 130 catch and hold end 176 of bag holder hook 116 and keep bagging clip tool 108 coupled to bag holder hook 116. In some embodiments, locking protrusion 136 is eliminated, so that locking protrusion 136 is not a part of clip 110 or bagging clip tool 108.

In some embodiments, clip 110 includes strap 140, as shown in FIG. 2 and FIG. 3. Strap 140 in this embodiment is coupled to disk 142 through a strap hole 138. Strap 140 is used to couple clip 110 to bagging station 112 so that bagging clip tool 108 does not get misplaced, lost, or stolen. Strap 140 can couple to bagging station 112, to bag holder 114, or to bag holder hook 116, for example, but not by way of limitation. Strap 140 can be a wire, a rope, a string, a strap, a cord, or any other elongate element that can couple bagging clip tool 108 to bagging station 112.

Bagging clip tool 108 includes bar 180 and pair of wheels 189. Bar 180 is coupled to handle second end 172 of handle 170 together forming a T bar. Handle 170 extends from handle first end 171 coupled to clip 110, to handle second end 172 and bar 180. Pair of wheels 189 are coupled to handle second end 172 by being coupled to bar 180.

Bar 180 is a length of rigid material such as, but not limited to, metal, plastic, or wood. Bar 180 has a bar first end 181, a bar second end 182, a bar length 183, and a bar longitudinal axis 175, as shown in FIG. 7. FIG. 7 shows bagging clip tool 108 with pair of wheels 189 removed so that bar 180 can be easily seen. Bar 180 is coupled to handle second end 172 such that a bar length 183 of bar 180 extends perpendicular to handle 170. Bar longitudinal axis 175 is perpendicular to handle longitudinal axis 169. Bar 180 is a means to couple pair of wheels 189 to handle second end 172. Bar first end 181 has a first wheel retainer clip 184 as shown in FIG. 7. Bar second end 182 has a second wheel retainer clip 185 as shown in FIG. 7. First and second wheel retainer clips 184 and 185 are bulbous ends of bar 180 that keep a first and a second wheel 190 and 194 on bar 180.

Pair of wheels 189 includes first wheel 190 and second wheel 194. First and second wheel 190 and 194 are coupled to handle second end 172 by being coupled to bar 180. First wheel 190 is coupled to bar first end 181 by sliding first wheel 190 over first wheel retainer clip 184. First wheel retainer clip 184 locks first wheel 190 onto bar 180 at first end 181. First wheel 190 rotates about bar 180 and bar longitudinal axis 175. Second wheel 194 is coupled to bar second end 182 by sliding second wheel 194 over second wheel retainer clip 185. Second wheel retainer clip 185 locks second wheel 194 onto bar 180 at second end 182. Second wheel 194 rotates about bar 180 and bar longitudinal axis 175. First and second wheel 190 and 194 independently rotate about bar 180. This means that first wheel 190 can rotate in a direction 198 as shown in FIG. 3, for example, while second wheel 194 rotates in a direction 199.

With bagging clip tool 108 hanging from bag holder hook 116 as shown in FIG. 1 and FIG. 2, pair of wheels 189 provide a surface to help separate the front side of shopping bag 120 from the rear side of shopping bag 120, which helps a user to open shopping bag 120 so it can be filled. This eliminates fumbling at the opening of shopping bag 120 to try to open it. In this embodiment, wheels 190 and 194 are made of rubber and include a plurality of knobs 192 (FIG. 3 and FIG. 6, in which some, but not all, knobs 192 are numbered for simplicity). The rubber wheels 190 and 194 and knobs 192 catch the plastic of the front side of bag 120 and help to separate the front side from the rear side of shopping bag 120.

Figure 8:
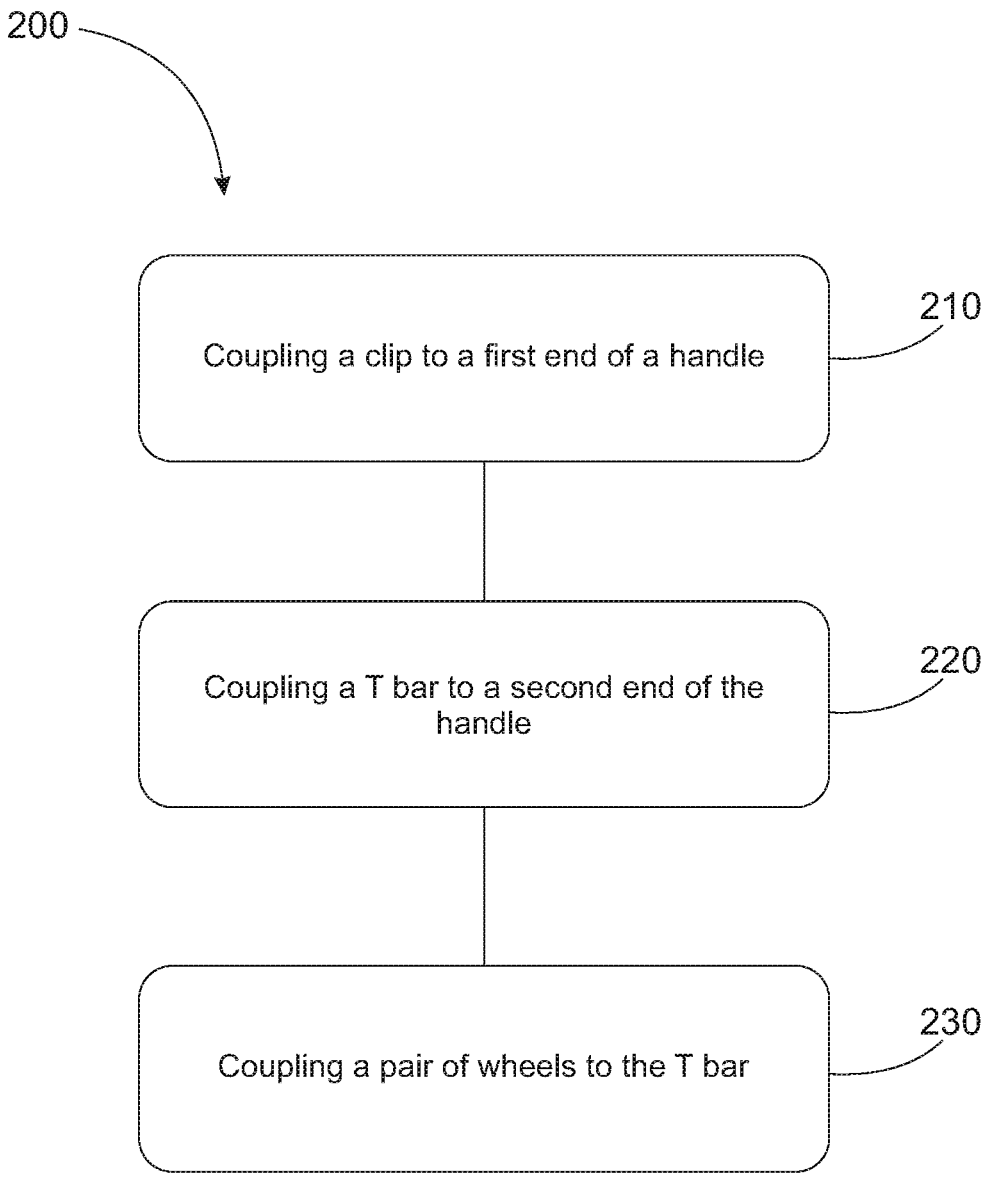
FIG. 8 illustrates a method of forming a bagging clip tool for a bagging station.

FIG. 8 illustrates a method 200 of forming a bagging clip tool for a bagging station. Method 200 includes an act 210 of coupling a clip to a handle. The handle is an elongate bar having a handle first end, a handle second end, and a handle longitudinal axis extending from the handle first end to the handle second end. In some embodiments, the clip is coupled to the handle first end.

Method 200 also includes an act 220 of coupling a T bar to the handle second end of the handle. The T bar is an elongate bar having a T bar first end, a T bar second end, and a T bar longitudinal axis. In some embodiments, act 220 of coupling the T bar to the second end of the handle includes coupling the T bar to the second end such that the T bar is perpendicular to the handle. The T bar is an elongate member with a T bar first end and a T bar second end. The T bar has a length that extends perpendicular to the handle in some embodiments. The pair of wheels are coupled to the handle by being coupled to the T bar.

Method 200 includes an act 230 of coupling a pair of wheels to the T bar. In some embodiments, act 230 of coupling the pair of wheels to the handle includes coupling a first wheel to the T bar first end, and coupling a second wheel to the T bar second end. The wheels independently rotate. The wheels help to grab the front side of the shopping bag and help a user to open the shopping bag.

The clip is used to couple the bagging clip tool to the bagging station. In some embodiments, method 200 includes forming a first and a second slot through a disk to form the clip, where the first and the second slot couple the clip to the bagging station. In some embodiments, method 200 includes forming a first slot in a flat disk to form the clip. In some embodiments, method 200 includes forming a second slot in the flat disk, wherein the first and the second slot both couple to the bagging station. In some embodiments, the clip couples to a bag holder hook of a bag holder of the bagging station. In some embodiments, the bag holder hook includes two rails, and the first slot couples to a first rail and the second slot couples to a second rail of the pair of rails. In some embodiments, act 210 of coupling the first end of the handle to the clip includes coupling the first end of the handle to the clip between the first and the second slot. In some embodiments, the handle extends from the disk between the first and the second slot.

A bagging clip tool has been shown and described that couples to the bag holder hook of a bag holder at a bagging station. The bagging clip tool keeps one or a stack of plastic shopping bags that are hung from the bag holder hook from falling off of the bag holder hook when one of the shopping bags is removed. The clip includes a disk with at least one slot. The slot couples to a rail of the bag holder hook. With the clip coupled to the end of the bag holder hook, the plurality of shopping bags remain hung from the bag holder hook when a shopping bag is removed. The pair of wheels provide a device which allows for easy opening of the shopping bag by providing a rubber, rotating surface that catches one side of the shopping bag and separates it from the other side, so the shopping bag can be pulled open and filled. The pair of wheels is coupled to the clip using a handle and a T Bar. The bagging clip tool can be coupled to the bag holder or the bagging station using a strap or a tie and a strap hole in the clip.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A bagging station for dispensing at least one shopping bag in a retail store, the bagging station comprising:

a bag holder having a bag holder hook that holds the at least one shopping bag; and a bagging clip tool coupled to the bag holder, the bagging clip tool comprising:

an elongate handle with a handle first end, a handle second end opposing the handle first end, and a handle longitudinal axis extending from the handle first end to the handle second end;

a clip extending from the handle first end, wherein the clip couples to the bag holder hook;

and a pair of wheels coupled to the handle second end, wherein the bagging clip tool helps to keep the at least one shopping bag hung from the bag holder hook in place as one of the at least one shopping bag is opened, filled, and then removed from the bag holder.

2. The bagging station of claim 1, wherein the clip comprises a disk having at least one slot, wherein the disk extends from the handle first end.

3. The bagging station of claim 2, wherein the at least one slot comprises a first slot and a second slot, wherein the first slot and the second slot are on either side of the handle.

4. The bagging station of claim 2, wherein the at least one slot couples the clip to a rail of the bag holder hook.

5. The bagging station of claim 3, wherein the disk further comprises:

a strap hole; and a locking protrusion extending from a front surface of the disk.

6. The bagging station of claim 3, wherein the bagging clip tool further comprises a bar extending from the handle second end, wherein the bar is an elongate bar having a bar first end, a bar second end opposing the bar first end, and a bar longitudinal axis extending from the bar first end to the bar second end, and wherein the bar longitudinal axis is perpendicular to the handle longitudinal axis wherein the bar and the handle together form a T bar.

7. The bagging station of claim 6, wherein a first wheel of the pair of wheels is coupled to the bar first end, and wherein a second wheel of the pair of wheels is coupled to the bar second end.

8. The bagging station of claim 7, wherein the first and the second wheel both rotate about the bar longitudinal axis.

9. The bagging station of claim 8, wherein the bagging station further comprises a center section and the bag holder is coupled to a side of the center section, wherein the bag holder comprises a support bar having a first handle holder arm coupled to a support bar first end, a second handle holder arm coupled to a support bar second end, and wherein the bag holder hook is coupled to the support bar between the first handle holder arm and the second handle holder arm.

10. The bagging station of claim 9, wherein the bag holder hook comprises a first and a second rail, and wherein the first slot of the disk couples to the first rail, and the second slot of the disk couples to the second rail.

11. A bagging clip tool comprising:

a handle having a handle first end, a handle second end opposing the handle first end, and a handle longitudinal axis extending from the handle first end to the handle second end;

a clip extending from the handle first end;

a bar extending from the handle second end; and a pair of wheels coupled to the bar, wherein the clip comprises a disk having a first slot adjacent a handle first side and a second slot adjacent a handle second side.

12. The bagging clip tool of claim 11, wherein the handle extends from the disk between the first and the second slot.

13. The bagging clip tool of claim 12, wherein the bar comprises:

a bar first end; and a bar second end;

wherein a first wheel of the pair of wheels is coupled to the bar first end, and wherein a second wheel of the pair of wheels is coupled to the bar second end.

14. The bagging clip tool of claim 13, wherein the bar further comprises a bar longitudinal axis extending from the bar first end to the bar second end, and wherein the bar longitudinal axis is perpendicular to the handle longitudinal axis.

* * * * *